US008865638B2

(12) United States Patent
Adamy

(10) Patent No.: US 8,865,638 B2
(45) Date of Patent: Oct. 21, 2014

(54) UNIT DOSE LAUNDRY COMPOSITIONS

(71) Applicant: Church & Dwight Co., Inc., Princeton, NJ (US)

(72) Inventor: Steven T. Adamy, Lawrenceville, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 13/832,114

(22) Filed: Mar. 15, 2013

(65) Prior Publication Data

US 2014/0274859 A1 Sep. 18, 2014

(51) Int. Cl.

| | |
|---|---|
| ***C11D 17/04*** | (2006.01) |
| ***C11D 1/12*** | (2006.01) |
| ***C11D 1/83*** | (2006.01) |
| ***C11D 1/831*** | (2006.01) |
| ***C11D 3/37*** | (2006.01) |
| ***C11D 17/00*** | (2006.01) |

(52) U.S. Cl.
CPC ..... *C11D 17/0039* (2013.01)
USPC ..... 510/296; 510/336; 510/356; 510/357; 510/439; 510/475

(58) Field of Classification Search
CPC ..... C11D 17/043; C11D 1/831; C11D 1/83; C11D 1/12; C11D 3/3765
USPC ..... 510/296, 439, 475, 496, 336, 356, 357
See application file for complete search history.

(56) References Cited

U.S. PATENT DOCUMENTS

| | | | | |
|---|---|---|---|---|
| 3,308,067 | A | 3/1967 | Diehl | |
| 3,936,448 | A | 2/1976 | Lamberti | |
| 4,526,698 | A | 7/1985 | Kuroda et al. | |
| 4,652,391 | A | 3/1987 | Balk | |
| 5,004,557 | A * | 4/1991 | Nagarajan et al. | 510/337 |
| 5,476,608 | A | 12/1995 | Boyer et al. | |
| 6,479,448 | B2 | 11/2002 | Cropper et al. | |
| 6,521,581 | B1 | 2/2003 | Hsu et al. | |
| 6,686,325 | B2 | 2/2004 | Hoyt et al. | |
| 7,615,524 | B2 | 11/2009 | Del Duca et al. | |
| 7,910,535 | B2 * | 3/2011 | Panandiker et al. | 510/296 |
| 2003/0134766 | A1 | 7/2003 | Jones et al. | |
| 2004/0186034 | A1 | 9/2004 | Verrall et al. | |
| 2006/0063691 | A1 | 3/2006 | Carlomagno et al. | |
| 2006/0275566 | A1 * | 12/2006 | de Buzzaccarini et al. | 428/35.2 |
| 2006/0281658 | A1 | 12/2006 | Kellar et al. | |
| 2009/0048134 | A1 * | 2/2009 | Roberts | 510/230 |
| 2011/0152159 | A1 * | 6/2011 | Labeque | 510/296 |
| 2011/0223125 | A1 * | 9/2011 | Hough et al. | 424/70.12 |
| 2011/0224393 | A1 | 9/2011 | Durant et al. | |
| 2012/0053105 | A1 | 3/2012 | Olson et al. | |

FOREIGN PATENT DOCUMENTS

| | | | |
|---|---|---|---|
| DE | 2321001 | A1 | 11/1973 |
| GB | 1261829 | A | 1/1972 |
| GB | 1379241 | A | 1/1975 |
| GB | 1387447 | A | 3/1975 |
| GB | 1389732 | A | 4/1975 |
| GB | 1398421 | A | 6/1975 |
| GB | 1398422 | A | 6/1975 |
| GB | 1425343 | A | 2/1976 |
| GB | 1439000 | A | 6/1976 |
| NL | 7205873 | A | 11/1972 |
| WO | 9318124 | A1 | 9/1993 |
| WO | 2006130647 | A1 | 12/2006 |
| WO | 2007111888 | A1 | 10/2007 |

OTHER PUBLICATIONS

Itaconix SAP100 Technical Datasheet. 2011. www.itaconix.com.

* cited by examiner

*Primary Examiner* — Lorna M Douyon
(74) *Attorney, Agent, or Firm* — Stuart D. Frenkel

(57) ABSTRACT

It has been found that by incorporating a polymer made from vinyl dicarboxylic acid monomers into a liquid laundry detergent composition, the composition can include at least about 30 wt. % water, and be useful in a liquid-containing water-soluble unit dose pouch.

14 Claims, No Drawings

UNIT DOSE LAUNDRY COMPOSITIONS

FIELD OF THE INVENTION

The present invention is directed to liquid laundry detergents provided in the form of a water-soluble pouch containing the liquid laundry detergent.

BACKGROUND OF THE INVENTION

Laundry detergent compositions, contained within a water-soluble pouch, are seeing wider use among consumers for reasons of convenience. Consumers are attracted to such single dose products because such products are less likely to result in spillage or dripping. Further, the unit dose laundry detergent pouches are advantageous since the consumer does not come into direct contact with the ingredients of the composition. Pouches associated with these products are typically composed of poly(vinyl alcohol) or poly(vinyl alcohol) copolymer films which can dissolve in water over a matter of seconds. The high aqueous solubility of such films necessitates a payload composition that contains a minimum amount of water. Typically, such compositions contain less than 10% water by weight.

It is generally believed that high water content liquid laundry detergents are incompatible with water-soluble films because of their water content. Thus, the attendant advantages of high water content liquid laundry detergents over other forms of laundry detergents such as granules, pastes, gels, and mulls have not been available in water-soluble unit dosage form. The advantages of liquid laundry detergents over granules, pastes, gels, and mulls include their aesthetic appearance and the faster delivery and dispersibility of the detergent ingredients to the laundry wash liquor, especially in a cool or cold water washing process.

The smaller amounts of water contained in water soluble pods have implications for both formulation and wash performance. For example, a smaller amount of water can limit the ability of certain materials to be incorporated into the composition, e.g. salts, water-soluble polymers (like anti-redeposition polymers), and water-soluble dyes. It is also well-known that removal of the chemical reactives in the payload are correlated with the extent of dissolution. As active ingredients in anhydrous formulations may not be released into the wash until full dissolution occurs, unit dose "pods" with higher water concentrations may exhibit faster action in the wash. Finally, as water is typically the least expensive component in a formulation, it is advantageous from a cost standpoint to employ the maximum amount of water, while still maintaining the desired performance.

There is a need, then, for unit dose systems with a level of water higher than that typically found in the prior art.

SUMMARY OF THE INVENTION

It has been found that by incorporating a polymer made from vinyl dicarboxylic acid monomers into a liquid laundry detergent composition, the composition can include at least about 30 wt. % water and be useful in a liquid-containing water-soluble unit dose pouch.

DETAILED DESCRIPTION OF THE INVENTION

In accordance with the present invention, an article is provided for use in the laundry process which comprises a package comprising a water-soluble material in film form containing a liquid laundry detergent. More particularly, the article is an aqueous liquid laundry detergent contained in a package, preferably a pouch or packet, containing a unit dose of the liquid laundry detergent, the package comprising a water soluble film-forming material that dissolves when placed in the laundry wash water so as to release the liquid laundry detergent. According to the invention, the water-soluble film-forming material is in substantially direct contact with the liquid laundry detergent, with the film-forming material maintaining its structural integrity prior to addition to a laundry wash liquor. The liquid detergent is capable of remaining homogeneous over a relatively wide temperature range, such as might be encountered in storage, and the pouch is capable of rapid dissolution in water even after extended storage.

The water-soluble package of this invention is preferably made from polyvinyl alcohol, but can also be cast from other water-soluble materials such as polyethylene oxide or methyl cellulose. Suitable water-soluble films are well known in the art, and are commercially available from numerous sources.

The liquid laundry detergent for use in this invention is formulated in a manner which makes it compatible with the water-soluble film for purposes of packing, shipping, storage, and use. According to the instant invention, compatibility of the liquid laundry detergent with the water-soluble film is achieved by the use of a polymer made from vinyl dicarboxylic acid monomers in the liquid laundry detergent. The liquid laundry detergent is a concentrated, heavy-duty liquid detergent which, as noted above, contains more than about 10% water, and preferably more than about 30% water, expressed as a percentage by weight of the overall detergent composition.

The liquid laundry detergent package itself can be of any configuration, but conveniently may have a rectangular or square shape when viewed normally to the plane of its two longest dimensions. A rectangular or square packet is more easily manufactured and sealed than other configurations when using conventional packaging equipment.

Pouches can be prepared according to the known methods in the art. More specifically, the pouches are prepared by first cutting an appropriately sized piece of film/sheet. The sheet is folded to form the necessary number and size of compartments and the edges of the folds are sealed using any suitable technology, such as, for example, heat sealing.

The laundry detergent compositions used may include a variety of different ingredients, including builder compounds, surfactants, enzymes, bleaching agents, alkalinity sources, colourants, perfume, lime soap dispersants, organic polymeric compounds including polymeric dye transfer inhibiting agents, crystal growth inhibitors, heavy metal ion sequestrants, metal ion salts, enzyme stabilizers, corrosion inhibitors, suds suppressers, solvents, fabric softening agents, optical brighteners and hydrotropes. In particular, the compositions of this invention will contain significantly more water than 10 wt. %, which has been a typical limiting amount when liquid compositions are incorporated in the water-soluble pouches. In general, the amount of water in the compositions of the present invention will be at least about 30 wt. % and, preferably, will range from about 35 to 45 wt. %.

The relatively high percentage of water allows for a single-phase system to be prepared for formulations containing a combination of nonionic and anionic surfactants. The relatively high percentage of water also results in a loose gel or loose paste (meringue) consistency or texture, which allows the formulation to readily disperse and dissolve during the wash cycle. The high percentage of water, therefore, provides both a product efficacy and a product cost advantage.

The higher level of water which can be included in the composition of this invention for incorporation into a water-soluble pouch is achieved by the addition of a polymer made from vinyl dicarboxylic acid monomers, which will be present in amounts generally from about 0.2 to 10.0 wt. % of the composition, preferably, from about 0.5 to 5.0 wt. % and, more preferably, from 1 to 3 wt. %. The monomers suitable for polymerization herein first include vinyl type monomers that have the following general structure:

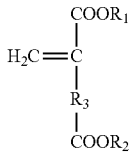

wherein $R_1$ and $R_2$ are selected from a hydrogen atom or an alkyl group (e.g.—$(C_nH_{2n+1})$ where n has a value of 1-18), or an aromatic group, or a cyclic alkyl group or a polyether, and combinations thereof. In addition, $R_3$ may be selected from an alkyl group, aromatic functionality, heteroaromatic functionality, cyclic alkyl group, heterocylic group, or combinations thereof, wherein at least 50 mole % of $R_1$ and $R_2$ are hydrogen atoms which provide carboxylic acid functionality. In addition, in a particularly preferred embodiment, $R_1$ and $R_2$ are both hydrogen atoms, which results in the monomer generally known as itaconic acid.

Any of the above monomers may be present in the final polymer produced herein as pure homopolymeric resin. However, comonomers may also be employed in conjunction with the above monomeric compounds, which may then provide random copolymer structure. With respect to the use of the following comonomers, it should be appreciated that the vinyl monomers noted above containing the indicated $R_3$, $R_2$ and $R_3$ functionality may be preferentially present at a level of equal to or greater than 50 wt. %. Accordingly, the comonomers that may then be utilized include any vinyl type monomer that would be suitable for copolymerization, including but not limited to acrylate monomers (such as methyl methacrylate, methyl acrylate, 2-hydroxyethyl acrylate, polyethyleneoxidediacrylate), vinyl acetate, vinyl halides, styrene, acrylamides, olefin monomers (e.g. ethylene or propylene) and acrylonitrile. In addition, the comonomers may include vinyl type anhydride monomers, such as maleic acid anhydride, itaconic acid anhydride as well as other acidic functionalized monomers, such as citraconic acid or measaconic acid (however, as noted herein, the levels of these latter monomers may require selected control of the concentration in the polymerization medium). Comonomers may also extend to water soluble type monomers, such as vinyl alcohol or vinyl acetate-vinyl alcohol mixtures.

Furthermore, one may utilize multifunctional type vinyl monomers in the event that one desires to achieve some level of crosslinking. For example, one may preferably employ a multifunctional vinyl monomer, which may be understood to be a monomer that provides two or more vinyl type groups suitable for chain-type addition polymerization. One example of such a difunctional monomer is polyethyleneglycoldiacrylate (PEGDA), which may have the following structure: $H_2C{=}CHCO(OCH_2CH_2)_nO_2CCH{=}CH_2$, wherein n may assume a value of 1-500.

The compositions of the present invention may contain a builder compound, typically present at a level of from 1% to 40% by weight.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more than two carbon atoms, carbonates, bicarbonates, borates, phosphates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates. 2,5-tetrahydrofuran-cis-dicarboxylates, 2,2,5,5-tetrahydrofuran-tetracarboxylates, 1,2,3,4,5,6-hexanehexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures, are also contemplated as useful builder components.

Borate builders, as well as builders containing borate-forming materials that can produce borate under detergent storage or wash conditions can also be used, but are not preferred at wash conditions less than 50° C., especially less than 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321,001 published on Nov. 15, 1973.

Highly preferred builder compounds for use in the present invention are water-soluble phosphate builders. Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from 6 to 21, and salts of phytic acid.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

Suitable surfactants are selected from mixtures of anionic and nonionic surfactants, although cationic and zwitterionic surfactants and mixtures thereof may also be included in minor amounts. The total surfactant content is generally at relatively high levels of from 10% to 70% by weight, more preferably from 20% to 70% by weight, most preferably from 30% to 60% by weight of the composition of active detergent components.

Essentially any nonionic surfactant useful for detersive purposes can be included in the compositions. Preferred, non-limiting classes of suitable useful nonionic surfactants include the alkyl ethoxylate condensation products of aliphatic alcohols with from 1 to 25 moles of ethylene oxide wherein the alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Water soluble ethoxylated $C_6$-$C_{18}$ fatty alcohols and $C_6$-$C_{18}$ mixed ethoxylated/propoxylated fatty alcohols are also suitable surfactants for use herein. Preferably, the ethoxylated fatty alcohols are the $C_{10}$-$C_{18}$ ethoxylated fatty alcohols with a degree of ethoxylation of from 3 to 50, most preferably these are the $C_{12}$-$C_{18}$ ethoxylated fatty alcohols with a degree of ethoxylation from 3 to 40. Preferably, the mixed ethoxylated/propoxylated fatty alcohols have an alkyl chain length of from 10 to 18 carbon atoms, a degree of ethoxylation of from 3 to 30 and a degree of propoxylation of from 1 to 10.

Surfactants formed from the condensation of ethylene oxide with a hydrophobic base formed by the condensation of propylene oxide with propylene glycol are also suitable for use herein. The hydrophobic portion of these compounds will preferably have a molecular weight of from 1500 to 1800 and exhibit water insolubility. Examples of compounds of this type include certain of the commercially-available Pluronic™ surfactants, marketed by BASF.

Surfactants formed from the condensation of ethylene oxide with the product resulting from the reaction of propylene oxide and ethylenediamine are also suitable for use herein. The hydrophobic moiety of these products consists of the reaction product of ethylenediamine and excess propylene oxide, and generally has a molecular weight of from 2500 to 3000. Examples of this type of nonionic surfactant include certain of the commercially available Tetronic™ compounds, marketed by BASF.

Essentially, any anionic surfactant useful for detersive purposes is suitable. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides, such as the sulfates of alkylpolyglucoside.

Alkyl sulfate surfactants are preferably selected from the linear and branched primary $C_{10}$-$C_{18}$ alkyl sulfates, more preferably the $C_{11}$-$C_{15}$ branched chain alkyl sulfates and the $C_{12}$-$C_{14}$ linear chain alkyl sulfates.

Alkyl ethoxysulfate surfactants are preferably selected from the group consisting of the $C_{10}$-$C_{18}$ alkyl sulfates which have been ethoxylated with from 0.5 to 20 moles of ethylene oxide per molecule. More preferably, the alkyl ethoxysulfate surfactant is a $C_{11}$-$C_{18}$, most preferably $C_{11}$-$C_{15}$ alkyl sulfate which has been ethoxylated with from 0.5 to 7.0, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic sulfonate surfactants suitable for use herein include the salts of $C_5$-$C_{20}$ linear alkylbenzene sulfonates, alkyl ester sulfonates, $C_6$-$C_{22}$ primary or secondary alkane sulfonates, $C_6$-$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_xCH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2—O)_x—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

The liquid detergent compositions of the invention may also contain various solvents as carriers. Low molecular weight primary or secondary alcohols exemplified by methanol, ethanol, propanol, and isopropanol are suitable. Other suitable carrier materials are glycols, such as mono-,di-,tripropylene glycol, glycerol, and polyethylene glycols (PEG), having a molecular weight of from 200 to 5000. The composition may contain from 1 to 50%, typically, 5 to 30% by weight of said carriers.

EXAMPLES

Compositions

The following compositions were prepared (all in wt. % on an actives basis):

| Sample # | Neodol 25-7 (C12-15, 7EO ethoxylated alcohol) | Naconol 90G (90% active Na-dodecylbenzene sulfonate) | Itaconix SAP100 | PEG 400 | 0.025M polybor(aq) |
|---|---|---|---|---|---|
| 1 | 13.33 | 6.67 | 0 | 40.00 | |
| 2 | 13.33 | 6.67 | 0.20 | 39.80 | |

-continued

| Sample # | Neodol 25-7 (C12-15, 7EO ethoxylated alcohol) | Naconol 90G (90% active Na-dodecylbenzene sulfonate) | Itaconix SAP100 | PEG 400 | 0.025M polybor(aq) |
|---|---|---|---|---|---|
| 3 | 13.33 | 6.67 | 1.00 | 39.00 | |
| 4 | 13.33 | 6.67 | 3.00 | 37.00 | 40.0 |
| 5 | 26.67 | 13.33 | 0 | 20.00 | |
| 6 | 26.67 | 13.33 | 0.20 | 19.80 | |
| 7 | 26.67 | 13.33 | 1.00 | 19.00 | |
| 8 | 26.67 | 13.33 | 3.00 | 17.00 | |

It is noted that the 40% level of the 0.25M polybor ($Na_2B_8O_{13}.4H_2O$) solution results in a level of about 39.6% water in the composition of each formula.

Unit Dose Samples

Unit dose "pods" were prepared by placing approximately 35 g of each composition in a pocket of poly(vinyl alcohol) formed from films, having dimensions of about 3.5"×3.5". The films were of the M8630 type manufactured by Monosol. Two pods for each composition were prepared. Masses of the pod films and the films+payloads were recorded in order to calculate the initial levels of payload in each pod. The two pods for each composition were then placed in an 8 oz. glass jar, and the jars were placed in an oven at 50° C. The pods were observed after 6 days and after 31 days. Masses were also recorded at 31 days.

Observations are shown below:

| Sample | Observation after 6 days at 50° C. | Observation after 31 days at 50° C. |
|---|---|---|
| 1 | Pod films intact, but sticky and stretchy | Pod films broken |
| 2 | Pod films broken | Pod films broken |
| 3* | Pod skins intact and not sticky | Pod skins intact and not sticky |
| 4* | Pod skins intact and not sticky | Pod skins intact and not sticky |
| 5 | Pod films broken | Pod films broken |
| 6 | Pod films intact, but sticky and stretchy | Pod films intact, but sticky and stretchy, then broke during handling |
| 7 | Pod films intact, but sticky and stretchy | Pod films broken |
| 8* | Pod films intact, slightly sticky and stretchy | Pod films intact, slightly sticky and stretchy |

Compositions 3, 4 and 8 showed the best integrity, although the films of composition 8 were slightly plasticized. In examination of the % mass lost from the payloads of surviving pods, it can be seen (in the case of 3 and 4) that increasing the level of SAP100 decreased the level of mass lost (presumably due to water or other solvent loss). Values are shown below for each system where a final mass was measurable (i.e. no pod leakage during measurement). Values represent an average of two pods:

| Sample | Level of SAP100 (wt.%) | % Mass from Pod Payload |
|---|---|---|
| 3 | 1.00 | 3.2 |
| 4 | 3.00 | 0.60 |
| 6 | 0.20 | 4.0 |
| 8 | 3.00 | 1.1 |

While sample 6 appears to be an anomaly, the fact that sample pod 6 broke upon handling (and sample 7 broke during aging), while sample 8 did not, indicates that a minimum of 3.00% SAP100 was required to maintain film integrity for the systems having high surfactant and low PEG levels.

Water Activity

Water activity ($a_w$) is technically the ratio of the vapor pressure of water in the test material (p) to the vapor pressure of pure water (po) at the same temperature:

$$a_w = p/p_o$$

However, $a_w$ is also an indication of the (thermodynamic) chemical potential of water in the system, and is a measure of the degree to which water is "bound" or unavailable for interaction with other components or processes. It is well known that the level of water activity has implications for the dissolution of solutes, and, for most materials, there is a critical level of water activity required for dissolution to occur.

Water activity values for the experimental systems were measured using a Pawkit (Decagon Devices, Inc.) water activity meter. Results are shown below:

| Sample # | $a_w$ |
|---|---|
| 1 | 0.88 |
| 2 | 0.87 |
| 3 | 0.88 |
| 4 | 0.87 |
| 5 | 0.91 |
| 6 | 0.92 |
| 7 | 0.92 |
| 8 | 0.93 |

While we might have expected that pod film survival would be related to water activity, this did not seem to be the case in the above data. For example, samples 3 and 4 (which exhibited very good film stability) exhibited values of $a_w$ similar to samples 1 and 2 (which ruptured). Therefore, it was not certain that the addition of SAP100 imparted decreased water activity to the samples and thus aided in film stability. The mechanism by which SAP100 was beneficial, therefore, remains unknown at this time.

The invention claimed is:

1. An article comprising an aqueous gel or paste laundry detergent, containing: (1) between 30% to 45% by weight of water; (2) from 20 to 70% by weight of at least one surfactant selected from the group consisting of a nonionic surfactant, an anionic surfactant and mixtures thereof; and (3) a polymer made from crosslinking vinyl dicarboxylic acid monomers comprising itaconic acid, and a package for said laundry detergent which is in direct contact with said laundry detergent, wherein said package is formed from a water-soluble film-forming material, and wherein said polymer is present in a concentration sufficient to render said film-forming material insoluble with respect to the laundry detergent contained within said package.

2. The article of claim 1, wherein the water-soluble film-forming material is polyvinyl alcohol.

3. The article of claim 1, wherein said polymer is a crosslinked polyitaconic acid.

4. The article of claim 1, wherein said polymer is present in amounts of from about 0.5 to 10.0 wt. % of said detergent.

5. The article of claim 4, wherein said polymer is present in amounts of from 1 to 3 wt. % of said detergent.

6. The article of claim 1, wherein said surfactant is a mixture of nonionic and anionic surfactants.

7. The article of claim 6, wherein the total content of said surfactant is present in an amount of from 30 to 60 percent by weight of said detergent.

8. The article of claim 1, wherein said surfactant is an ethoxylated alcohol nonionic surfactant.

9. The article of claim 1, wherein said surfactant is a linear alkylbenzene sulfonate anionic surfactant.

10. The article of claim 1, wherein said surfactant is a mixture of an ethoxylated alcohol nonionic surfactant and a linear alkylbenzene sulfonate anionic surfactant.

11. The article of claim 10, wherein said polymer is a crosslinked polyitaconic acid.

12. The article of claim 11, wherein said polymer is present in amounts of from about 0.5 to 10.0 wt. % of said detergent.

13. The article of claim 12, wherein said polymer is present in amounts of from 0.5 to 5.0 wt. % of said detergent.

14. The article of claim 13, wherein said polymer is present in amounts of from 1 to 3 wt. % of said detergent.

* * * * *